US006910434B2

(12) United States Patent
Lundgren

(10) Patent No.: US 6,910,434 B2
(45) Date of Patent: Jun. 28, 2005

(54) CONTROL DEVICE FOR STEERING KITE ON A BOAT

(76) Inventor: Edwin Lundgren, Dorfstrasse 9, DE-23684 Scharbeutz (DE)

( * ) Notice: Subject to any disclaimer, the term of this patent is extended or adjusted under 35 U.S.C. 154(b) by 0 days.

(21) Appl. No.: 10/362,679

(22) PCT Filed: Aug. 30, 2001

(86) PCT No.: PCT/EP01/10002

§ 371 (c)(1),
(2), (4) Date: Jun. 23, 2003

(87) PCT Pub. No.: WO02/18202

PCT Pub. Date: Mar. 7, 2002

(65) Prior Publication Data

US 2004/0035345 A1 Feb. 26, 2004

(30) Foreign Application Priority Data

Aug. 31, 2000 (DE) ..... 100 43 138
Sep. 29, 2000 (DE) ..... 200 16 988 U

(51) Int. Cl.[7] ..... B63H 9/04; B63H 9/06

(52) U.S. Cl. ..... 114/102.1; 114/39.21; 114/39.29; 114/102.16

(58) Field of Search ..... 114/39.29, 39.12, 114/39.13, 39.16, 39.18, 39.21, 102.1, 102.16, 102.17, 102.18, 102.21; 244/153 R, 155 R, 155 A

(56) References Cited

U.S. PATENT DOCUMENTS 2,126,665 A * 8/1938 Rowland ..... 114/39.29
4,127,247 A 11/1978 Strasilla ..... 244/152
4,497,272 A 2/1985 Veazey ..... 114/103
5,056,447 A * 10/1991 Labrador ..... 114/39.26
5,642,683 A 7/1997 Bedford ..... 114/103
6,003,457 A * 12/1999 Chatelain ..... 114/39.11
6,732,670 B2 * 5/2004 Rayner ..... 114/39.21
2003/0140835 A1 * 7/2003 Wrage ..... 114/102.1

FOREIGN PATENT DOCUMENTS

DE 29 33 050 A1 2/1981
DE 35 18 131 A1 11/1986
DE 199 28 166 A1 2/2000
DE 19928166 A1 * 2/2000 ..... B63H/9/04
FR 2 690 129 A1 10/1993
GB 2 098 951 A 12/1982
GB 2130971 A * 6/1984 ..... B63H/9/04

OTHER PUBLICATIONS

One page English Abstract from esp@cenet for DE 19928166 A1, Feb. 2000.
One page English Abstract from esp@cenet for FR 2690129 A1, Oct. 1993.
One page English Abstract from esp@cenet for DE 3518131 A1, Nov. 1986.
"Selbsttatige Fock: So funktioniert sie richtig", Yacht Magazine, vol. 12, p. 102, Jun. 1991.
"Selbermachen: Abnehmbarer Traveller", Yacht Magazine, vol. 13, p. 94, Jun. 1994.

* cited by examiner

*Primary Examiner*—S. Joseph Morano
*Assistant Examiner*—Ajay Vasudeva
(74) *Attorney, Agent, or Firm*—Howson and Howson

(57) ABSTRACT

A control device for a steering kite on a boat. The steering kite can be steered by a steering device and at least two or three, preferably at least four or five, suspension lines. The control device comprises at least one force introduction rail that extends horizontally over the water line and on which a deviation device for the suspension lines is positioned in such a way that it can move back and forth. The rail is fixed to the boat between the steering kite and the steering device in such a way that the traction force of the steering kite produces torque about the longitudinal axis and/or the transverse axis of the boat in the water, by means of which the leeward side of the boat is lifted upwards.

17 Claims, 10 Drawing Sheets

CONTROL DEVICE FOR STEERING KITE ON A BOAT

FIELD OF THE INVENTION

The invention concerns a control device for a steering kite of a vehicle, which steering kite is dirigible by at least two or three, preferably by at least four or five, flight lines by means of a steering device. The invention particularly concerns a control device for a steering kite on a boat, so that in the following, a boat is mainly mentioned without connecting any limitation therewith.

BACKGROUND OF THE INVENTION

Such steering kites, which can for example be styled as so-called tube kites or soft kites, are generally known. The tube kites get their aerodynamic form by inflation of form-giving elements. Soft kites get the intended aerodynamic shape by picking up air during the first flight minutes. Normally, the steering kites are controlled and steered into the intended direction by two or four flight lines and a corresponding steering device to which the flight lines are attached. Frequently, the arrangement is made such that the steering kite is attached in a relatively firm way to the body by two force lines of the four flight lines via a tie-bar. The steering kite is steered by the two other flight lines, the steering lines. An additional third or fifth line is used as security line or as start line. Such a steering kite can catch very strong wind forces, and it is known to use these for the propulsion of a vehicle, for example a beach buggy or a surfboard.

The propulsion of a boat by means of wind force takes place in the classical manner by a sail that is attached to a vertically aligned mast. Optimal wind exploitation should be caused by a multiplicity of sails. However according to the alignment of the sail at the mast, the boat is inclined by the wild to the wind-averted side. A force-component is generated downwards as a consequence of this inclination whereby the boat is pressed more deeply into the water and therefore the displacement resistance will be increased. Moreover, the effective wind capturing area of the sail decreases in the driving direction. Thus, speed keeps within limits.

From U.S. Pat. No. 4,497,272 and DE 35 18 131 A1 it is known to drive boats with the help of so called floating sails. Here, the sails are only attached over support cables to the boat and are held up with a balloon. Generally, a force component of the wind force can also be generated with such floating-sails in such a way, that the wind-averted side of the boat immerses more deeply into the water. This has a consequence that a capsize of the boat is inevitable with too strong wind forces, since a floating-sail always offers the same wind-capturing area despite the increasing inclination of the boat in contrast to conventional sails.

From document DE 1 99 28 166 A1 a boat is known which is driven by a steering kite, in which the point of application of force of the force line or force lines should lie at the same height or below the form centre of gravity or centre of buoyancy. For this, a guiding rail is provided which moves the linking point of the force lines over the hull downward in direction of the keel. Therefore, the kite is positioned on the one or the other side of the boat and at least one force line of the kite runs below the waterline. It is obvious that such a construction of an attaching-device for the steering kite entails considerable problems.

Document EP 0 853 576 B1 discloses a boat, to which a kite-sail is attached by a rotating arm. In particular, the configuration here is chosen in such a way that the rotating arm is linked to the boat essentially at a position in which the conventional vertical mast would be positioned. Means are provided to swing the rotating arm around a horizontal axis, so that the outer end with the flight lines holds a relative position to the boat in which the wind-averted side of the boat is lifted from the water. The use of such a rotating arm has the disadvantage that it needs sufficient movement-area on the boat-deck due to its turning stiff construction. Also, the rotatable and pivotable bearing of the rotating arm at the linking point is extremely complicated and exposed to very high forces. Furthermore, the equipment for the rising or lowering of the rotating arm needs an extended space.

OBJECT OF THE INVENTION

It is an object of the invention to work out a control device for a steering kite of a boat of the above-mentioned type such that on the one hand the strong wind-forces can be picked up safely. On the other hand, it should be achieved that the wind-averted side of the boat is always lifted out of the water due to the wind-forces. Nevertheless, the control device should be produced with simple means and easily operated.

SUMMARY OF THE INVENTION

According to the invention, the object is solved by a control device that comprises at least one force input rail on which a deflection device for the flight lines is to and fro movable attached and which extends essentially horizontally above the waterline and is attached to the boat in such a way that the deflection device is aligned between the steering kite and the steering device so that a torque is generated by the pull force of the steering kite around the longitudinal axis and/or cross axis of the boat in the water, which torque lifts up the side of the boat averted to the wind. In particular, this is achieved by the fact that the deflection device is kept on the force input rail in any position at a distance to the rotation axis and/or longitudinal axis and/or cross axis of the boat, around which axes the boat would incline itself or turn itself in the water in case of an effect of a force. With that, the side of the boat averted from the wind is always lifted up independent of the alignment of the steering kite relative to the boat. An immersion of the lee-side and consequently a danger of capsize is thus reliably avoided.

On principle, the configuration of the force input rail is at will. It can be provided that the force input rail is essentially straight-lined and positioned in the fore area of the boat crosswise to the boat. It will here be achieved by simple means that the steering kite is positioned on either the one or the other side of the boat in dependence of the wind direction and boat driving direction and that the deflection device moves to the corresponding side while the steering device remains freely controllable behind the force input rail.

In accordance with a preferred embodiment of the invention it is provided that the force input rail is designed at least partially in form of a curve. Due to the design in form of a bow and especially due to a convex design of the force input rail in reference to the boat and its vertical rotating axis, the position of the deflection device can be optimised relative to the wind direction and the driving direction of the boat or can align itself well due to the position of the steering kite relative to the boat, respectively.

On principle, it is also possible that the force input rail is adapted to the contour of the fore area of the boat. Hereby, an optically appealing appearance is formed and the necessary torque to lift up the side of the boat averted from the wind is simultaneously generated.

According to another embodiment of the invention, it is provided that the force input rail is designed at least partially circular. In an advantageous manner the force input rail forms a closed circular ring. Hereby, any position of the steering kite relative to the boat can be achieved. Furthermore, a perfect movement of the deflection device on the force input rail is caused when aligning the steering kite relative to the boat.

It is useful that there is space in the area restricted by the force input rail for at least one person to operate the kite steering device. This is especially useful with one-man-boats in which the person not only steers the boat, but also operates the steering device.

It is furthermore useful that the deflection device each comprises at least one deflection pulley for at least the steering lines and force lines of the flight lines. With that, it is achieved that the flight lines can also perfectly be guided in the deflection device under high forces. For example, the deflection pulleys can be ball-bearing mounted. Furthermore, it can be useful here that the deflection device comprises guiding means which hold the flight lines on the deflection pulley. These guiding means can for example be formed as eyelets or bows that prevent the flight lines from coming off the deflection pulley. Roll-blocks conventionally used in navigation can also be used for guiding the lines. This is especially useful with a fast change of the alignment of the boat relative to the steering kite.

On principle, it is favourable if the deflection device is lockable on the force input rail. Hereby, a stable point of application of force is formed so that steady propulsion of the boat is possible. The deflection device, for example, can be locked by a brake to the force input rail.

On principle, it can be furthermore provided, that the deflection device is actively moveable on the force input rail, for example by set wheels and/or motor driven. Hereby, the point of application of force can be firmly defined, for example when starting the boat. However, the deflection device will in principle automatically be adjusted on the force input rail depending to the wind direction and the driving direction of the boat. This will especially be the case when using an essentially circular force input rail.

On principle, the steering device for the steering kite is operated manually. With bigger boats or when using several steering kites, it can be provided that the steering device for the steering kite each comprises servomotors for at least the steering lines and force lines of the flight lines. Thus, an automatic and optimised control of the steering kite is possible.

On principle, it is arbitrary which type of boat is driven by such a control device with a steering kite. For example, the boat can be a monohull-boat. Of course, it is also possible that the boat is a multihull-boat and, especially, a catamaran with two hulls. In this case it can be provided in an advantageous manner that the force input rail and its fastenings means connect the hulls with each other. In that way, a stable but light construction is formed. Since the boat always lifts itself upwards on the wind-averted side and thus out of the water independent of the wind force, high speeds can be achieved without danger of capsize.

BRIEF DESCRIPTION OF THE DRAWINGS

As set below, the invention is explained in more details with the help of the schematic drawing. It is shown in.

DETAILED DESCRIPTION OF THE PREFERRED EMBODIMENTS

Figure 1:
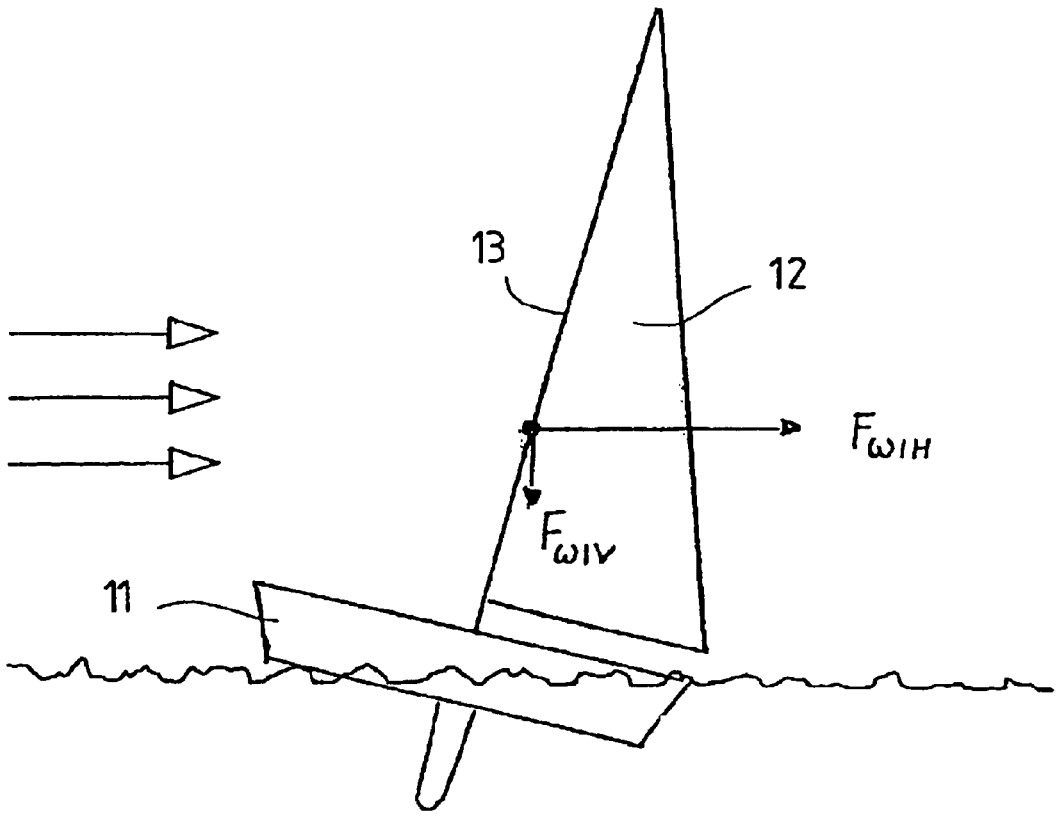
FIG.1 PRIOR ART
FIG. 1 the stern view of a conventional sail ship with the force components generated by the wind force, FIG. 2 the side view of a conventional sail ship, FIG. 3 a boat which is propulsable by a control device with a steering kite according to the invention, FIG. 4 a boat which is propulsable by a steering kite attached to force input rail positioned in a wrong way, FIG. 5 the top view on a boat with a force input rail according to a first embodiment of the invention, FIG. 6 the top view on a boat with a force input rail according to a second embodiment of the invention, FIG. 7 the top view on a multihull-boat with a force input rail according to a third embodiment of the invention, FIG. 8 the top view on a multihull-boat with a force input rail according to a fourth embodiment of the invention, FIG. 9 the stem view of a multihull-boat with an improperly disposed force input rail, FIG. 10 the stem view of a multihull-boat with a control device according to the invention, FIG. 11 the perspective view of a multihull-boat with a control device according to the invention, and FIG. 12 a cut view through the force input rail with the deflection device according to the invention.
Figure 2:
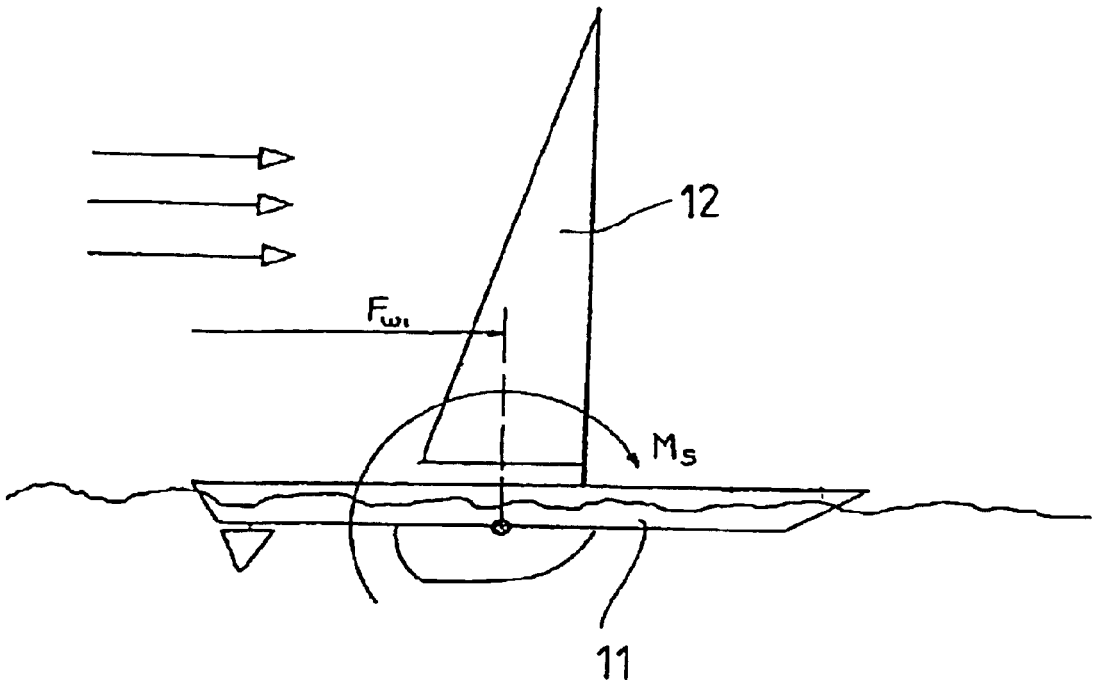
FIG. 2 PRIOR ART

In FIGS. 1 and 2 there are schematically represented the horizontal wind force FWIH and vertical wind force FWIV effecting on a sailboat and the inclination of the boat 11 resulting therefrom. Due to the wind force, the sail 12 attached in usual manner to a vertical mast 13 will incline the boat 11 at the wind averted side downwards. Therefore, it is always necessary to keep the boat essentially in the horizontal position in order to get a wind capturing area as big as possible. With too strong wind, this will not be possible even with greater counterbalances on the wind facing side, so that capsize becomes inevitable or a reduction of the sail area becomes necessary. As long as the wind comes from the back, there will also be generated an unfavourable torque MS for the propulsion of the boat 11 around its cross axis, as represented schematically in FIG. 2. This torque causes an immersion of the wind averted fore side, that is the bow side, such that with too strong winds the deck will be flushed over. Here also, a capsize can be the consequence.

Figure 3:
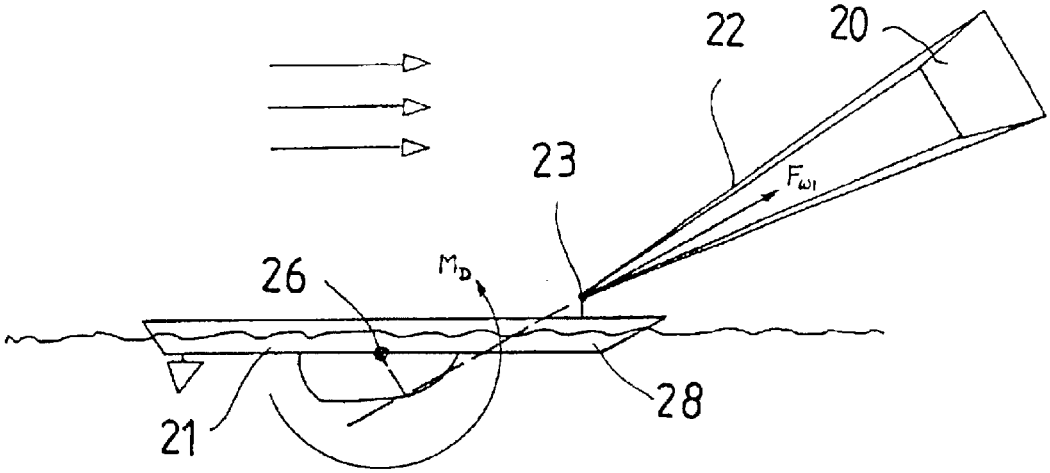

FIG. 3 shows schematically the linkage of a steering kite 20 to a boat 21. The steering kite 20 is steered and operated in usual manner by four flight lines 22 with a kite steering device 25 not shown in details. This kite steering device 25 includes attachment means for four flight lines of the kite by which flight lines an individual alignment of the steering kite 20 can be enabled by relative movements of the lines against each other and/or by changes of the lengths of single lines. Such steering devices are generally known and thus do not need any more explanation.

For the attachment of the steering kite 20 to the boat 21 there exists a force input rail 23 on which a deflection device for the flight lines 24 is attached and movable to and fro. The force input rail 23 is for example connected over pillars and supports to the boat. Here, the fastening means allows free movement of the deflection device on the force input rail. Such a force input rail and its fastening elements can be designed very stable so that a safe force reception and force application to the boat can be effected.

The position of the force input rail relative to the boat is chosen such that the force application to the boat by the deflection device generates a torque around the cross axis or longitudinal axis 26, 27, respectively which torque lifts the wind averted side of the boat out of the water. With wind exclusively coming from the back, this concerns the bow of the ship, with lateral wind attack, for example when cruising, this concerns the left or the right side of the boat. However, it is always achieved that the side in driving direction, that is the wind-averted side of the boat, is lifted out of the water. Thus, a gliding of the boat and a low resistance of the boat on the water are possible. The result is a higher achievable speed even when cruising against the wind.

The rotation axis, cross axis and longitudinal axis around which the boat will turn and tilt in case of an application of force are dependent on the respective construction and the depth of immersion of the boat. Therefore, it must be noted that the point of application of force, which is defined by the position of the deflection device 24 on the force input rail 23, is chosen such that a positive torque, that is a torque lifting the wind-averted side of the boat out of the water, is generated independently from the depth of immersion. This also applies to a land vehicle in which the tilt axis is defined by the contact surfaces of the wheels or runners on the ground.

Figure 4:
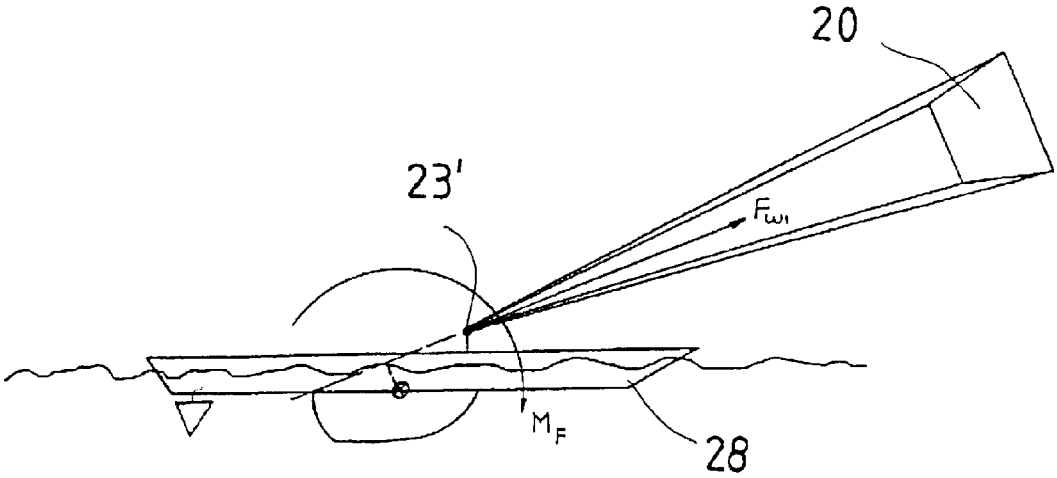

A correct design of the force input rail is schematically represented in FIG. 3. The position of the force input rail 23 is located relative far await from the cross axis 26 so that a positive torque MD is generated with respect to the hull and the wind-averted side 28 of the boat is lifted out of the water by the steering kite. A wrong positioning of the guiding rail 23' is shown in FIG. 4. Here, a negative torque MF is generated around the cross axis 26 by the wind force which effects on the steering kite 20. An immersion of the wind-averted side 28 and thus, the danger of capsize of the boat, would be the consequence.

Figure 5:
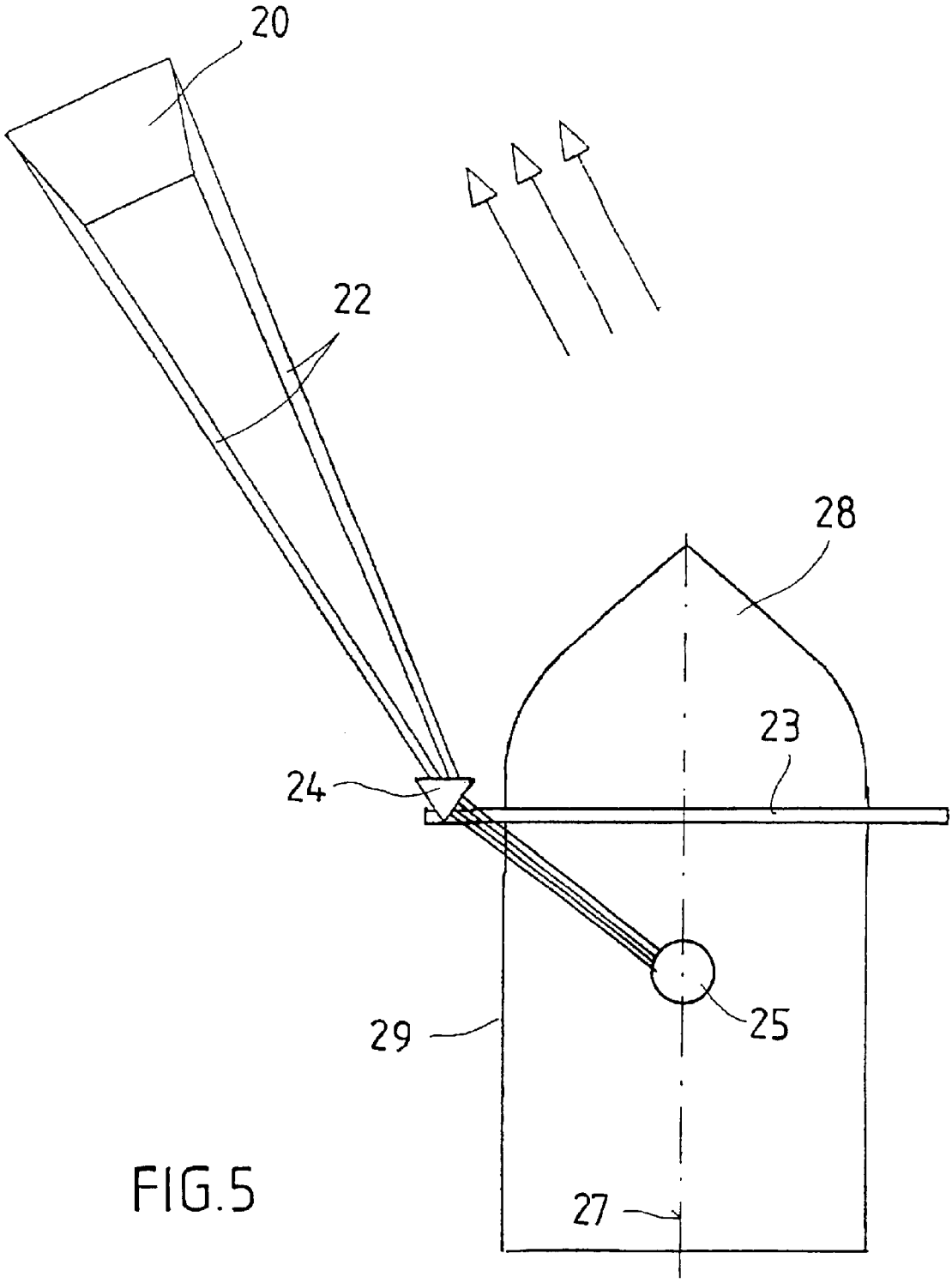

In FIG. 5 a simple embodiment of the control device in accordance with the invention is shown. The force input rail 23 is designed in a straight line proceeding horizontally and extends crosswise over the boat at its fore side region. Depending on the wind direction, the deflection device 24 will be located at the right or left side of the boat 21 as represented in the drawing. However, in any case, a torque is generated which lifts the wind-averted side, that is the bow 28 or the left side 29 with respect to the drawing, is lifted out of the water. It can be provided that the deflection device 24 is lockable on the guide rail 23 in order to enable a point of application of force, for example, in the middle of the force input rail when the wind comes only from the back.

Figure 6:
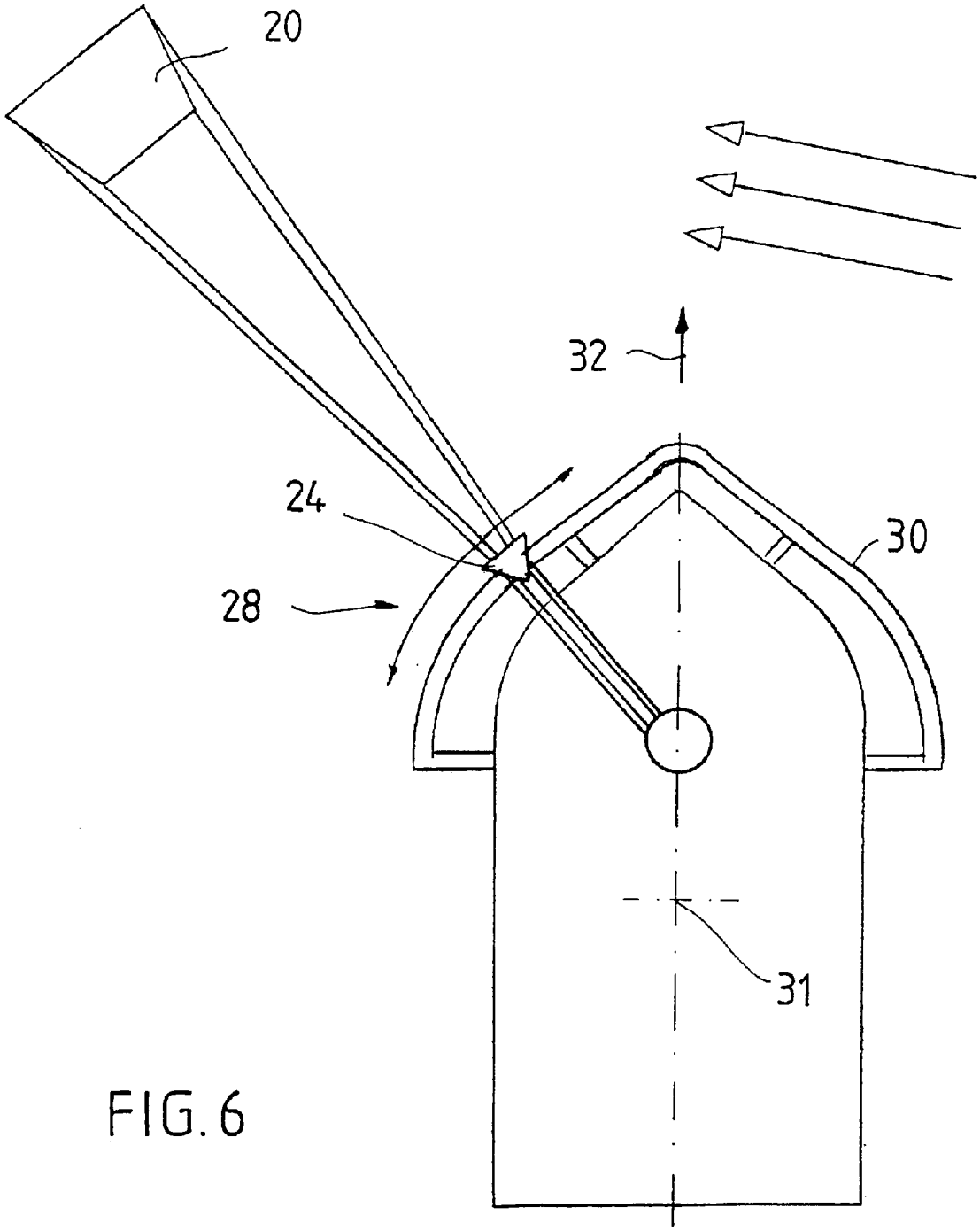

In the embodiment in accordance with FIG. 6, the force input rail is designed at least partially curved and is adapted to the contour of the bow 28 of the boat 21. It is obvious that an optimised alignment of the deflection device 24 relative to the boat 21 can be achieved. In this case it is sufficient also for cruising against the wind that the deflection device can only move about approximately 150° relative to the rotation axis 31 of the boat 21. This corresponds to the preferred alignment of the steering kite relative to the driving direction 32 of the boat.

Figure 7:
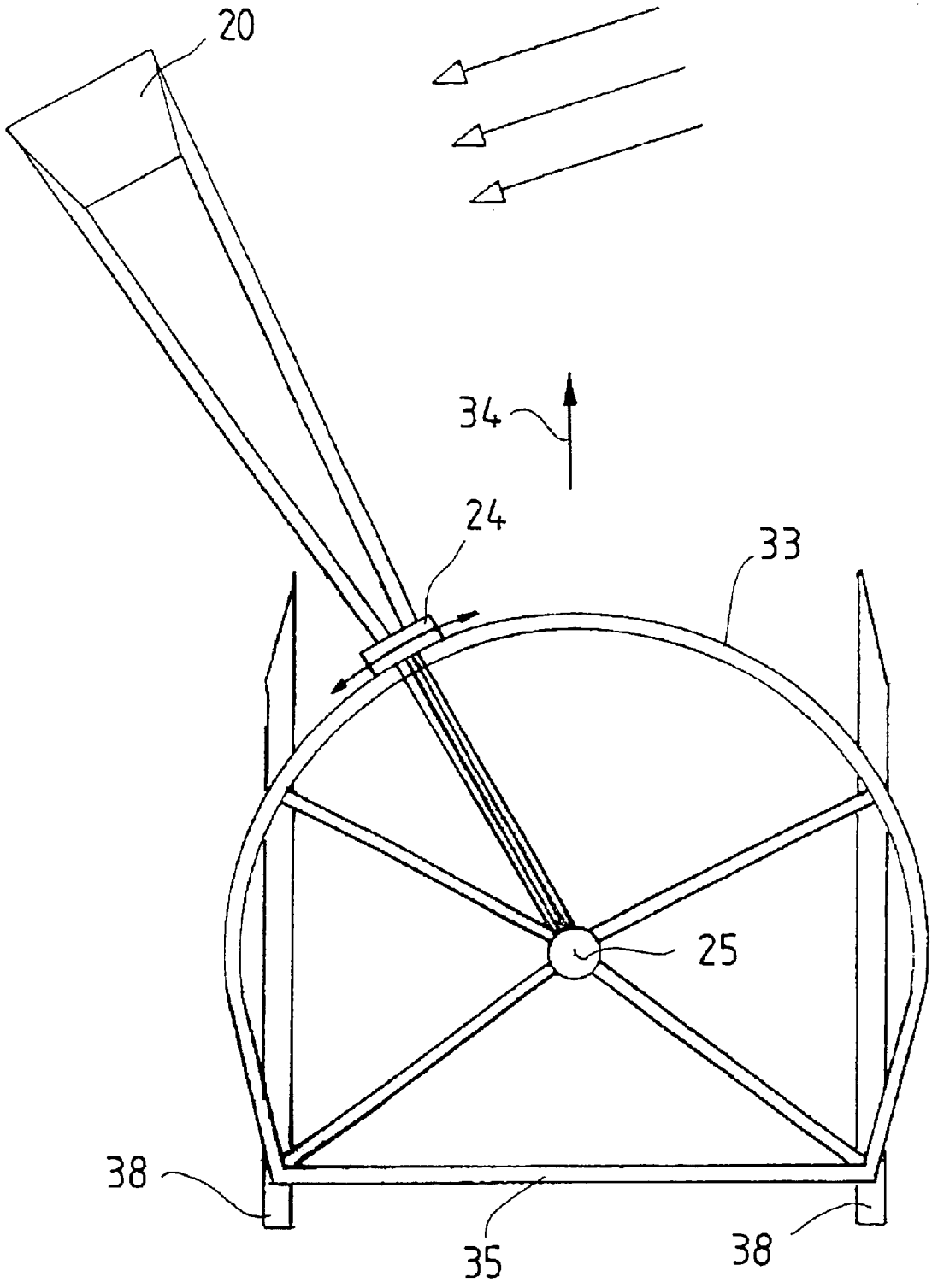

In FIG. 7, a multihull-boat is represented which comprises two individual hulls 38. Particularly, the arrangement is chosen such that the force input rail 33 is used as a connection element of the two hulls 38. As shown in FIG. 7, the force input rail is designed circular at least with respect to the forward movement 34 of the boat. The steering device 25 is positioned approximately in the centre of this circular ring. At the back, the force input rail is limited by a simple crossbeam 35. Therefore, in this embodiment shown in the drawing, the deflection device 24 can move on the force input rail 33 about approximately 240° around the centre and consequently around the rotation point of the boat.

Figure 8:
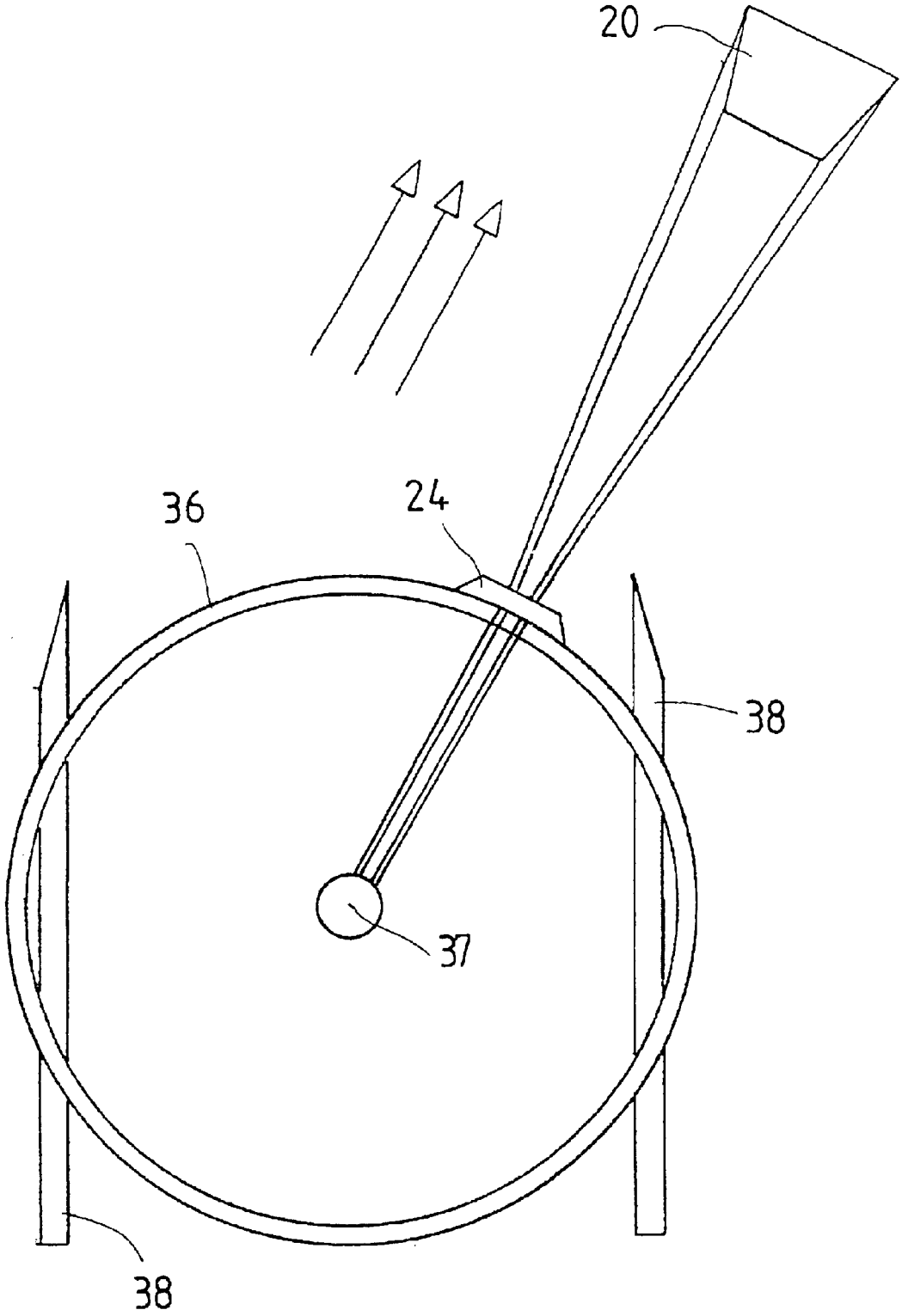

FIG. 8 shows another embodiment of a multihull-boat, in which the force input rail 36 is designed completely circular. It can be provided that this force input rail 36 extends concentric to the rotation axis 37 of the multihull-boat. Here also, the force input rail 36 simultaneously serves as a connective element of the two hulls 38. It is obvious that this construction, especially in accordance with FIG. 8, is simply built and allows an optimal alignment of the steering kite 20 relative to the boat.

Figure 9:
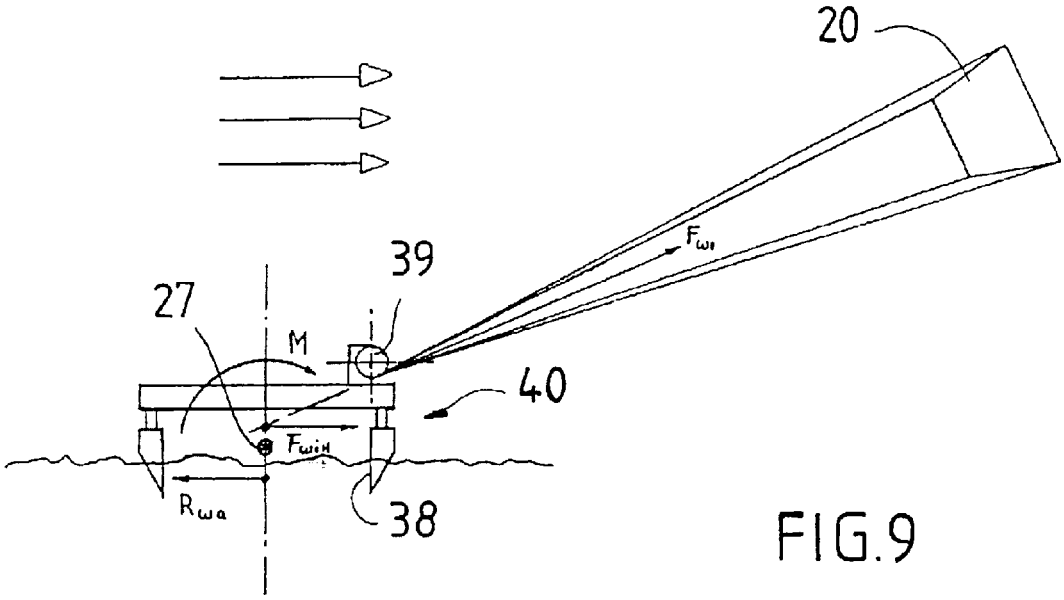

With a multihull-boat, attention must also be kept on the right location of the circular force input rail 33, 36. FIG. 9 shows a wrong dimensioning of the spacing of the individual hulls 38 with respect to the force input rail 39. Due to the wind force FWI at the steering kite 20, a wind force FWIH is generated effecting on the boat which force lies above the longitudinal axis 27. The reaction force of the boat in the water RWA acts below said axis. In total, a torque M is generated which will press the wind-averted side 40 of the boat into the water.

Figure 10:
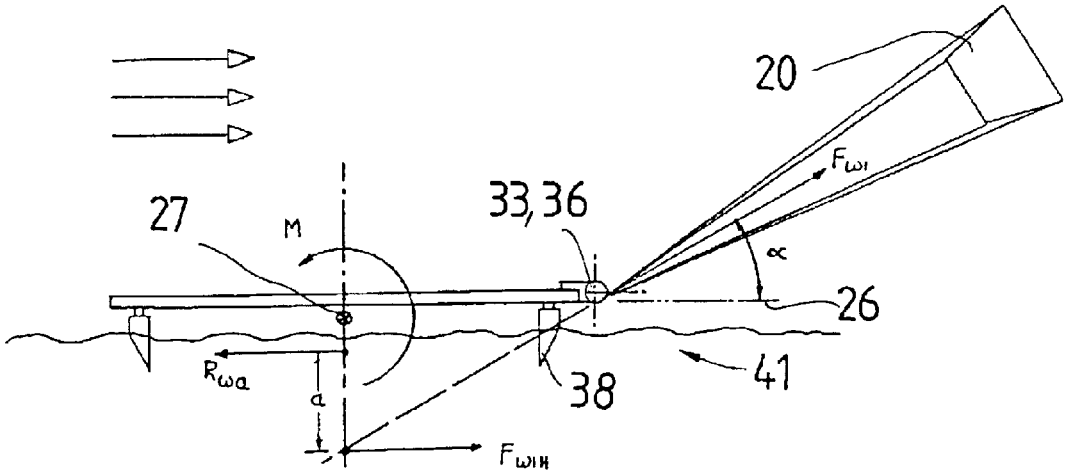

In FIG. 10, a correct dimensioning of the spacing of the individual hulls 38 and a correct position of the force input rail 33, 36 are represented. Due to the wind force FWI at the steering kite 20 which force acts on the boat under the angle $\alpha$ and due to the big distance of the force input rail to the longitudinal axis or cross axis 27, the horizontal component of the wind force FWIH will act below these axes at a distance "a" too. Thus, always a torque M is generated around the longitudinal axis 27 or around the cross axis 26, which torque lifts the wind-averted side 41 out of the water. It must further be noted that a low flying kite under a very small angle $\alpha$ will tend to generate a negative torque or no torque on the boat. This must especially be taken into account at the dimensioning of the spacing of the deflection device to the respective rotation axes and tilt axes. However, due to the aerodynamic requirements and for the exact steering of the steering kite, the angle $\alpha$ will lie in the range between 10° and 30° during normal operation. With that, a capsize of the boat is reliably avoided.

The at least partially circular force input rails restrict an area, in which is space for the steering device 25. Additionally, the area is dimensioned such that a person can staff therein for the operation of the steering device. Further the steering wheel for the rudder blades of the boat can be positioned therein so that a one-man-operation is possible.

Figure 11:
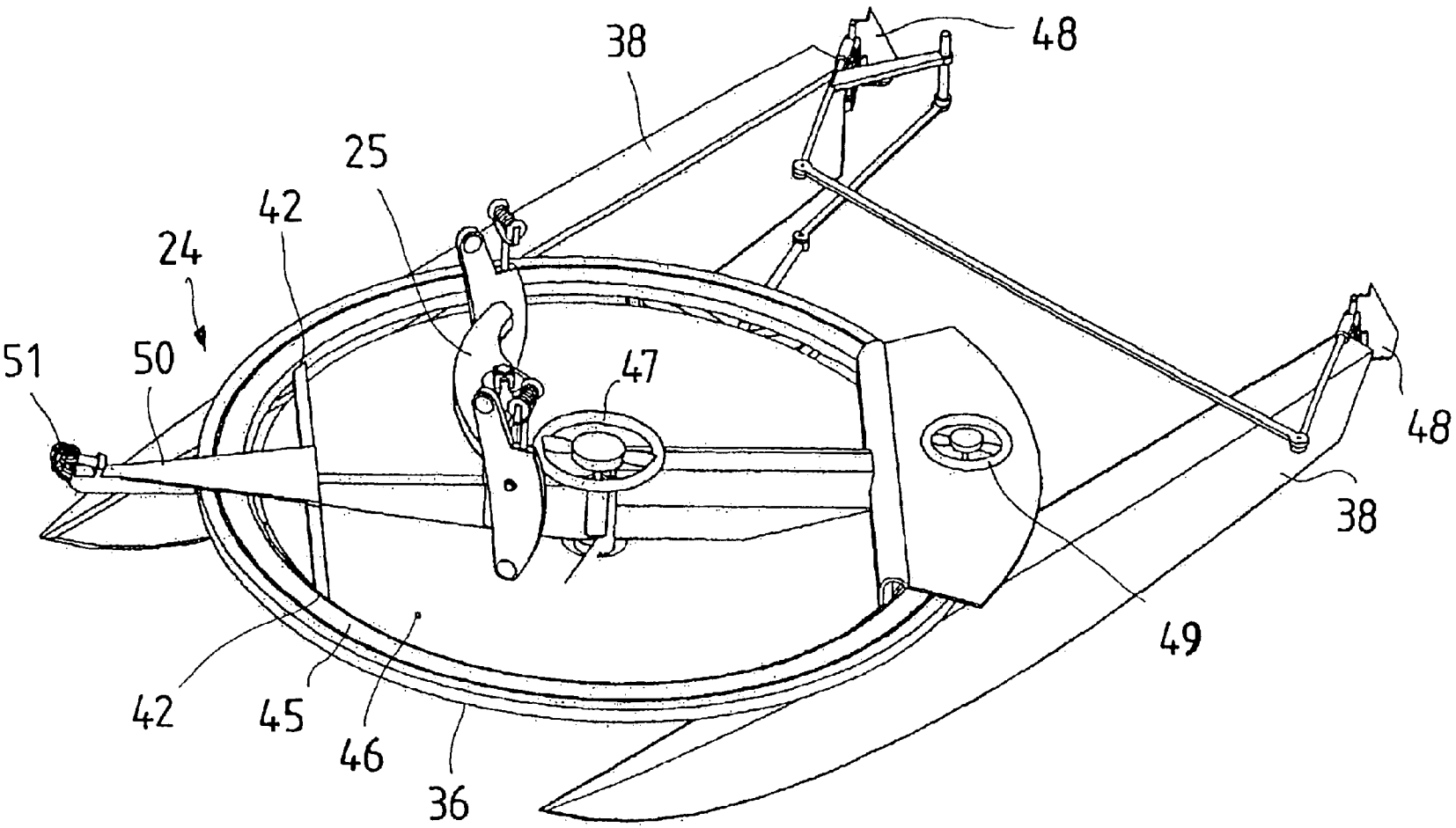
Figure 12:
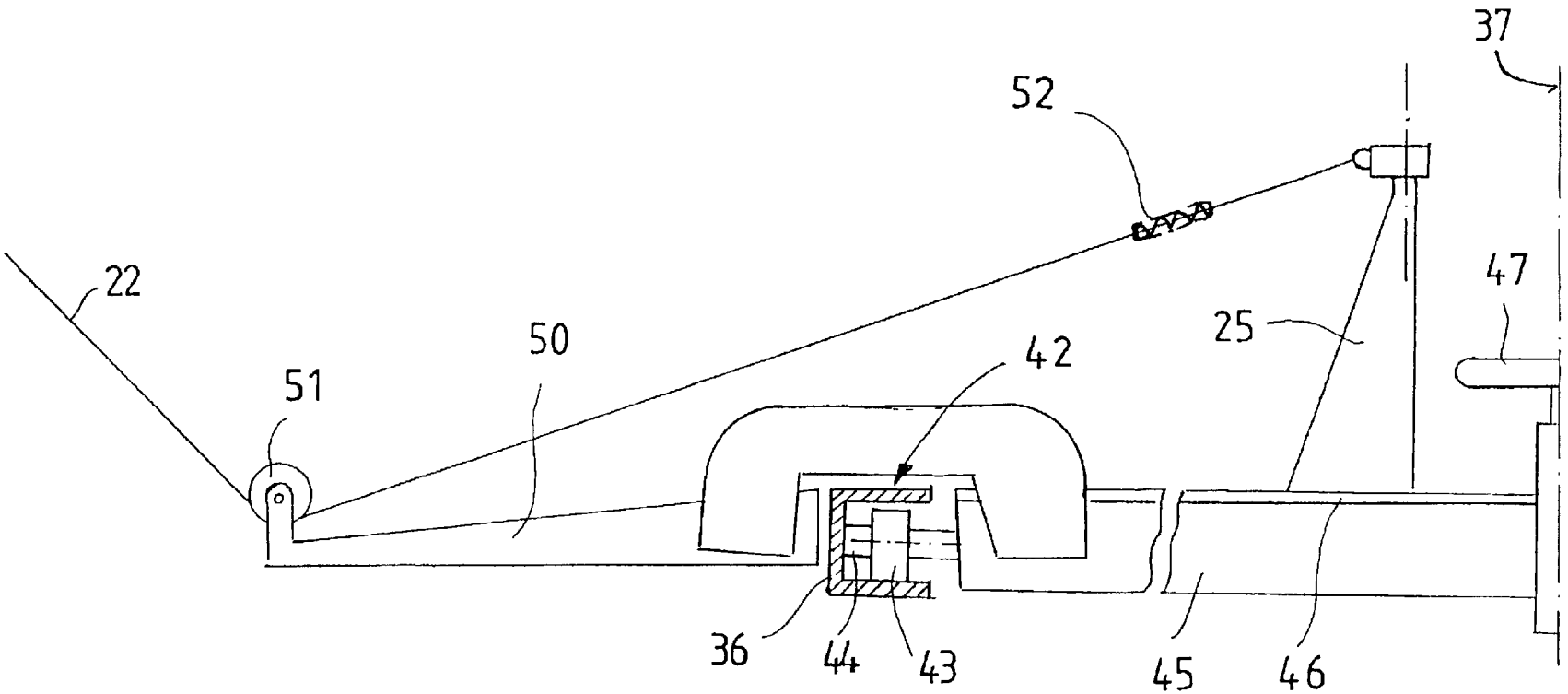

FIG. 11 shows in detail a perspective view of a multihull-boat with a circular force input rail 36. Two lateral hulls 38 are recognizable and are connected to each other by the force input rail 36. As shown in FIG. 12, the force input rail 36 can be designed as an inside opened C-shaped profile. This C-shaped profile forms a counter bearing for an arrangement of rolls 42 of the deflection device 24. Rollers 43 that are rotatable around a radial axis and rollers 44 that are rotatable around a tangential axis are provided. The rollers support the deflection device 24 both in direction of pull and upwards or downwards within the C-shaped profile.

The deflection device 24 is a component of an inner ring 45 which rotates inside the outer ring formed by the force input rail 36. Of course, this inner ring is provided with bearing rolls at several positions along its perimeter. Instead of a ring, a star-shaped structure, for example with three star arms, may also be sufficient. At the inner ring 45 or at the star-shaped structure, respectively, a plate 46 is attached, on which a person finds place for operating the kite steering device 25. In this represented embodiment, the steering wheel 47 for the rudders 48 at the end of each hull 38 runs through the rotation axis 37. With that, the inner ring 45 and the plate with the person remain freely turnable relative to the boat independent of the steering wheel and the rudder position. The brake 49 for locking the deflection device is arranged on the force input rail 36 at the side of the inner ring opposite to the deflection device 24.

The deflection device 25 comprises a crosspiece 50 which extends radially outwards of the force input rail 36. At the outer end, deflection pulleys 51 are located for the individual flight lines. With that, the point of application of force can be positioned outward relatively. Nevertheless, the construction remains compact.

The kite steering device 25 for the flight lines of the steering kite is anchored on the plate 46. The steering kite is steered as well as the pull forces are transferred to the boat for the forward movement by the kite steering device. The deflection device 24 displaces the point of application of force via force input rail in such a way that a positive torque is generated around the longitudinal axis and/or cross axis which torque lifts the boat on its wind-averted side out of the water.

Even here, the flight lines of the steering kite can also be distinguished in force lines and steering lines of the steering kite. In order to control sudden and vehement gusts, it is useful to build in a damper 52 between the steering device and the steering kite for at least two flight lines of the total of four flight lines. For example, a damper commonly acts for the two force lines. However, one damper can also be provided for each flight line. This damper can be a spring or a rubber-elastic element which is positioned in the flight line in question or by which the flight line or flight lines are attached to the steering device. With too strong forces by wind gusts, the damper slackens whereby an extension of the lines in question takes place. With that, the steering kite pours itself into the wind whereby a reduction of the effective surface is caused among other things. Then, the force effecting on the boat becomes smaller so that the gust is damped.

What is claimed is:

1. Control device for a steering kite of a vehicle, especially a boat, which steering kite (20) is steerable by at least two flight lines (22) by means of a steering device (25), said control device comprising at least one force input rail (22, 30, 33, 36) on which a deflection device (24) for the flight lines is attached and movable to and fro and which extends essentially horizontally above a waterline such that said deflection device (24) is kept on said force input rail (23) in any position at a distance from at least one of a longitudinal axis (27), a cross axis (26), and a rotation axis (31, 37) of the boat, so that a torque is generated by a pull force of the steering kite around at least one of the longitudinal axis and cross axis of the boat in the water by which torque a side (28, 29) of the boat averted to the wind is lifted up.

2. A control device according to claim 1, wherein said force input rail (23) is substantially straight-lined and positioned in the fore area of the boat crosswise to the boat.

3. A control device according to claim 1, wherein said force input rail (30, 33, 36) is at least partially in a form of a curve.

4. A control device according to claim 1, wherein said force input rail (33, 36) is circular.

5. A control device according to claim 1, wherein an area restricted by said force input rail provides a space for at least one person to operate said steering device (25).

6. A control device according to claim 1, wherein said flight lines (22) include steering lines and force lines, and wherein said deflection device (25) has at least one deflection pulley for at least said steering lines and said force lines of said flight lines (22).

7. A control device according to claim 6, wherein said deflection device (24) has a guiding means that holds said flight lines on said deflection pulley.

8. A control device according to claim 1, wherein said deflection device (24) is lockable on said force input rail (23, 30, 33, 36).

9. A control device according to claim 1, wherein said steering device (25) for said steering kite is anchored to the boat.

10. A control device according to claim 1, wherein the boat is a multihull-boat, such as a catamaran with two hulls (38).

11. Control device according to claim 10, wherein said force input rail (33, 36) connects the hulls to each other.

12. A control device according to claim 1, wherein said deflection device is positionable on said force input rail so that said torque is generated around said longitudinal axis of said boat.

13. A control device according to claim 1, wherein said deflection device is positionable on said force input rail so that said torque is generated around said longitudinal axis and said cross axis of said boat.

14. A control device according to claim 1, wherein said force input rail (30) is adapted to a contour of a fore area (28) of the boat.

15. A control device according to claim 1, wherein said flight lines (22) include steering lines and force lines, and wherein said force lines and at least two flight lines are attached by at least one damper to said steering device.

16. Control device according to claim 15, wherein said damper is one of a spring and a rubber-elastic intermediate element.

17. A control device according to claim 1, wherein said flight lines (22) include steering lines and force lines, and wherein said steering device has servomotors for said steering lines and force lines of said steering kite.

* * * * *

UNITED STATES PATENT AND TRADEMARK OFFICE

CERTIFICATE OF CORRECTION

PATENT NO. : 6,910,434 B2
DATED : June 28, 2005
INVENTOR(S) : Lundgren

It is certified that error appears in the above-identified patent and that said Letters Patent is hereby corrected as shown below:

Column 1,
Line 37, "wild to the" should read -- wind to the --.

Column 5,
Line 27, "far await from" should read -- far away from --.
Line 47, "staff therein for" should read -- stay therein for --.

Column 7,
Lines 44-55, should read:

1. Control device for a steering kite of a boat, comprising a steering kite (20) steerable by at least two flight lines (22) by means of a steering device (25) to which the flight lines are connected, and at least one force input rail (22, 30, 33, 36) on which a deflection device (24) for the flight lines is attached and movable to and fro and which extends essentially horizontally above a waterline such that said deflection device (24) is kept on said force input rail (23) in any position at a distance from at least one of a longitudinal axis (27), a cross axis (26), and a rotation axis (31, 37) of the boat, so that a torque is generated by a pull force of the steering kite around at least one of the longitudinal axis and cross axis of the boat in the water by which torque a side (28, 29) of the boat averted to the wind is lifted up for all steering kite positions relative to the boat during normal operations thereof.

Column 8,
Lines 14-18, should read:
6. A control device according to claim 1, wherein said flight lines (22) include steering lines and force lines, and wherein said deflection device (24) has at least one deflection pulley for at least said steering lines and said force lines of said flight lines (22).
Lines 40-42, should read:
14. A control device for a steering kite of a vehicle, which steering kite (20) is steerable by at least two flight lines (22) by means of a steering device (25), said control device comprising at least one force input rail (22, 30, 33, 36) on which a deflection device (24) for the flight lines is attached and movable to and fro and which extends essentially horizontally above a waterline such that said deflection device (24) is kept on said force input rail (23) in any position at a distance from at least one of a longitudinal axis (27), a cross axis (26), and a rotation axis (31,37) of the boat, so that a torque is generated by a pull force of the steering kite around at least one of the longitudinal axis and cross axis of the boat in the water by which torque a side (28, 29) of the boat averted to the wind is lifted up, said force input rail (30) is adapted to a contour of a fore area (28) of the boat.
Lines 43-46, should read:
15. A control device for a steering kite of a vehicle, which steering kite (20) is steerable by at least two light lines (22) by means of a steering device (25), said control device comprising at least one force input rail (22, 30, 33, 36) on which a deflection device (24)

UNITED STATES PATENT AND TRADEMARK OFFICE

CERTIFICATE OF CORRECTION

PATENT NO. : 6,910,434 B2
DATED : June 28, 2005
INVENTOR(S) : Lundgren

It is certified that error appears in the above-identified patent and that said Letters Patent is hereby corrected as shown below:

Column 8, (cont'd),
for the flight lines is attached and movable to and fro and which extends essentially horizontally above a waterline such that said deflection device (24) is kept on said force input rail (23) in any position at a distance from at least one of a longitudinal axis (27), a cross axis (26), and a rotation axis (31, 37) of the boat, so that a torque is generated by a pull force of the steering kite around at least one of the longitudinal axis and cross axis of the boat in the water by which torque a side (28, 29) of the boat averted to the wind is lifted up, said flight lines (22) include steering lines and force lines, and wherein said force lines and at least two flight lines are attached by at least one damper to said steering device.
Lines 50-53, should read:
17. A control device for a steering kite of a vehicle, which steering kite (20) is steerable by at least two flight lines (22) by means of a steering device (25), said control device comprising at least one force input rail (22, 30, 33, 36) on which a deflection device (24) for the flight lines is attached and movable to and fro and which extends essentially horizontally above a waterline such that said deflection device (24) is kept on said force input rail (23) in any position at a distance from at least one of a longitudinal axis (27), a cross axis (26), and a rotation axis (31, 37) of the boat, so that a torque is generated by a pull force of the steering kite around at least one of the longitudinal axis and cross axis of the boat in the water by which torque a side (28, 29) of the boat averted to the wind is lifted up, said flight lines (22) include steering lines and force lines, and wherein said steering device has servomotors for said steering lines and force lines of said steering kite.

Signed and Sealed this

Fourteenth Day of February, 2006

JON W. DUDAS
*Director of the United States Patent and Trademark Office*